US007252148B2

(12) United States Patent
Traylor

(10) Patent No.: US 7,252,148 B2
(45) Date of Patent: Aug. 7, 2007

(54) PLUNGER ACTUATED PUMPING SYSTEM

(75) Inventor: Leland B. Traylor, Draper, UT (US)

(73) Assignee: Smith International, Inc., Houston, TX (US)

( * ) Notice: Subject to any disclaimer, the term of this patent is extended or adjusted under 35 U.S.C. 154(b) by 329 days.

(21) Appl. No.: 10/886,731

(22) Filed: Jul. 8, 2004

(65) Prior Publication Data

US 2006/0008364 A1 Jan. 12, 2006

(51) Int. Cl.
*E21B 43/16* (2006.01)

(52) U.S. Cl. ..... 166/370; 166/68; 166/105; 417/395

(58) Field of Classification Search ..... 166/370, 166/68, 68.5, 105; 417/395
See application file for complete search history.

(56) References Cited

U.S. PATENT DOCUMENTS

| | | | | |
|---|---|---|---|---|
| 1,899,364 A | | 2/1933 | Tennant | |
| 1,940,516 A | | 12/1933 | Tennant | |
| 3,957,401 A | * | 5/1976 | Sweeney et al. | 417/395 |
| 4,488,853 A | * | 12/1984 | Benson | 417/240 |
| 5,353,870 A | * | 10/1994 | Harris | 166/68 |
| 6,017,198 A | | 1/2000 | Traylor et al. | |
| 6,550,535 B1 | | 4/2003 | Traylor | |
| 6,595,280 B2 | | 7/2003 | Traylor | |
| 6,889,765 B1 | | 5/2005 | Traylor | |
| 2004/0188096 A1 | | 9/2004 | Traylor | |
| 2005/0142005 A1 | | 6/2005 | Traylor | |

FOREIGN PATENT DOCUMENTS

| | | |
|---|---|---|
| DE | 577401 | 5/1933 |
| EP | 0 997 641 | 5/2000 |
| FR | 772225 | 10/1934 |

OTHER PUBLICATIONS

British Search Report for Appln. No. GB 0514048.8 dated Oct. 25, 2005; (4 p.).

* cited by examiner

*Primary Examiner*—Hoang Dang
(74) *Attorney, Agent, or Firm*—Conley Rose, P.C.

(57) ABSTRACT

Methods and apparatus for pumping fluids from a well utilizing a submersible pumping system. In one embodiment, the pump comprises a pump body operable to be disposed within tubing within a well. The pump body encloses a pump chamber having an inlet and an outlet. The inlet is in fluid communication with the well. A diaphragm is disposed within the pump chamber and forms a boundary between the pump chamber and a diaphragm chamber. A piston is moveably disposed within the diaphragm chamber. The piston may be moved within the diaphragm chamber by a pressure intensifier supplied with a pressure differential from the surface.

24 Claims, 5 Drawing Sheets

PLUNGER ACTUATED PUMPING SYSTEM

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND

The present invention relates generally to methods and apparatus for submersible pumping systems. More particularly, the present invention relates to methods and apparatus for submersible pumps used in artificial lift systems for producing low flow rate oil, gas and coal bed methane wells.

Hydrocarbons, and other fluids, are often contained within subterranean formations at elevated pressures. Wells drilled into these formations allow the elevated pressure within the formation to force the fluids to the surface. However, in low pressure formations, or when the formation pressure has diminished, the formation pressure may be insufficient to force the fluids to the surface. In these cases, a pump can be installed to provide the required pressure to produce the fluids.

The volume of well fluids produced from a low pressure well is often limited, thus limiting the potential income generated by the well. For wells that require pumping systems, the installation and operating costs of these systems often determine whether a pumping system is installed to enable production or the well is abandoned. Among the more significant costs associated with pumping systems are those for installing, maintaining, and powering the system. Reducing these costs may allow more wells to be produced economically and increase the efficiency of wells already having pumping systems.

There remains a need to develop lower cost, more efficient methods and apparatus for pumping fluids from a low pressure wellbore that overcome some of the foregoing difficulties while providing more advantageous overall results.

SUMMARY OF THE PREFERRED EMBODIMENTS

The embodiments of the present invention are directed toward methods and apparatus for pumping fluids from a well utilizing a submersible pumping system. In one embodiment, the pump comprises a pump body operable to be disposed within tubing within a well. The pump body encloses a pump chamber having an inlet and an outlet. The inlet is in fluid communication with the well. A diaphragm is disposed within the pump chamber and forms a boundary between the pump chamber and a diaphragm chamber. A piston is moveably disposed within the diaphragm chamber and may be moved within the diaphragm chamber by a pressure intensifier supplied with a pressure differential from the surface.

In certain embodiments, a pressure supply is disposed at the surface of the well and connected to the pressure intensifier by hydraulic tubing. The pressure supply may comprise a first supply of fluid at a first pressure and a second supply of fluid at a second pressure. The first pressure and the second pressure establish a pressure differential that is applied to the pressure intensifier to move the piston within the diaphragm chamber. In select embodiments, the first and second supplies of fluid are pressurized gases, wherein the pressure differential between the first and second supplies is applied to a hydraulic fluid disposed within the hydraulic tubing.

In an alternate embodiment a well pumping system comprises a hydraulic fluid supply located at the surface and operable to provide a first fluid pressure differential. Hydraulic tubing extends into the well from the hydraulic fluid supply to a submersible pump disposed within the well. A pressure intensifier is coupled to the hydraulic tubing and operable to apply the first fluid pressure differential to a piston. A diaphragm chamber contains a volume of hydraulic fluid, wherein a portion of the piston is disposed within the diaphragm chamber. A diaphragm forms a flexible barrier between the diaphragm chamber and a pump chamber in fluid communication with the well.

In certain embodiments the hydraulic fluid supply comprises a first gas supply at a first pressure and a second gas supply at a second pressure, wherein the second pressure is higher than the first pressure. The fluid supply also comprises a first pressurization chamber wherein either the first of second pressure is transferred to a first hydraulic fluid supply and a second pressurization chamber wherein either the first or second pressure is transferred to a first hydraulic fluid supply. A valve having a first position wherein the first pressure is applied to the first pressurization chamber and the second pressure is applied to the second pressurization chamber, wherein the valve has a second position wherein the first pressure is applied to the second pressurization chamber and the second pressure is applied to the first pressurization chamber. The valve shifts from the first to the second position in response to movement of the piston within the diaphragm chamber or in response to changes in the pressure within the pressurization chambers.

A well pumping method may comprise disposing a hydraulic submersible pump within the well, wherein the hydraulic submersible pump comprises a diaphragm pump and a pressure intensifier. Hydraulic tubing is connected from the hydraulic submersible pump to a fluid supply at the surface and hydraulic fluid is supplied from the surface to the pressure intensifier so as to actuate the diaphragm pump. The hydraulic fluid may be supplied at a first differential pressure or a second differential pressure. The first differential pressure expands the diaphragm pump to pressurize the fluid in the pump. The second differential pressure collapses the diaphragm pump to draw wellbore fluids into the pump.

Thus, the present invention comprises a combination of features and advantages that enable it to overcome various problems of prior devices. The various characteristics described above, as well as other features, will be readily apparent to those skilled in the art upon reading the following detailed description of the preferred embodiments of the invention, and by referring to the accompanying drawings.

BRIEF DESCRIPTION OF THE DRAWINGS

For a more detailed description of the preferred embodiment of the present invention, reference will now be made to the accompanying drawings, wherein.

DETAILED DESCRIPTION OF THE PREFERRED EMBODIMENTS

Figure 1:
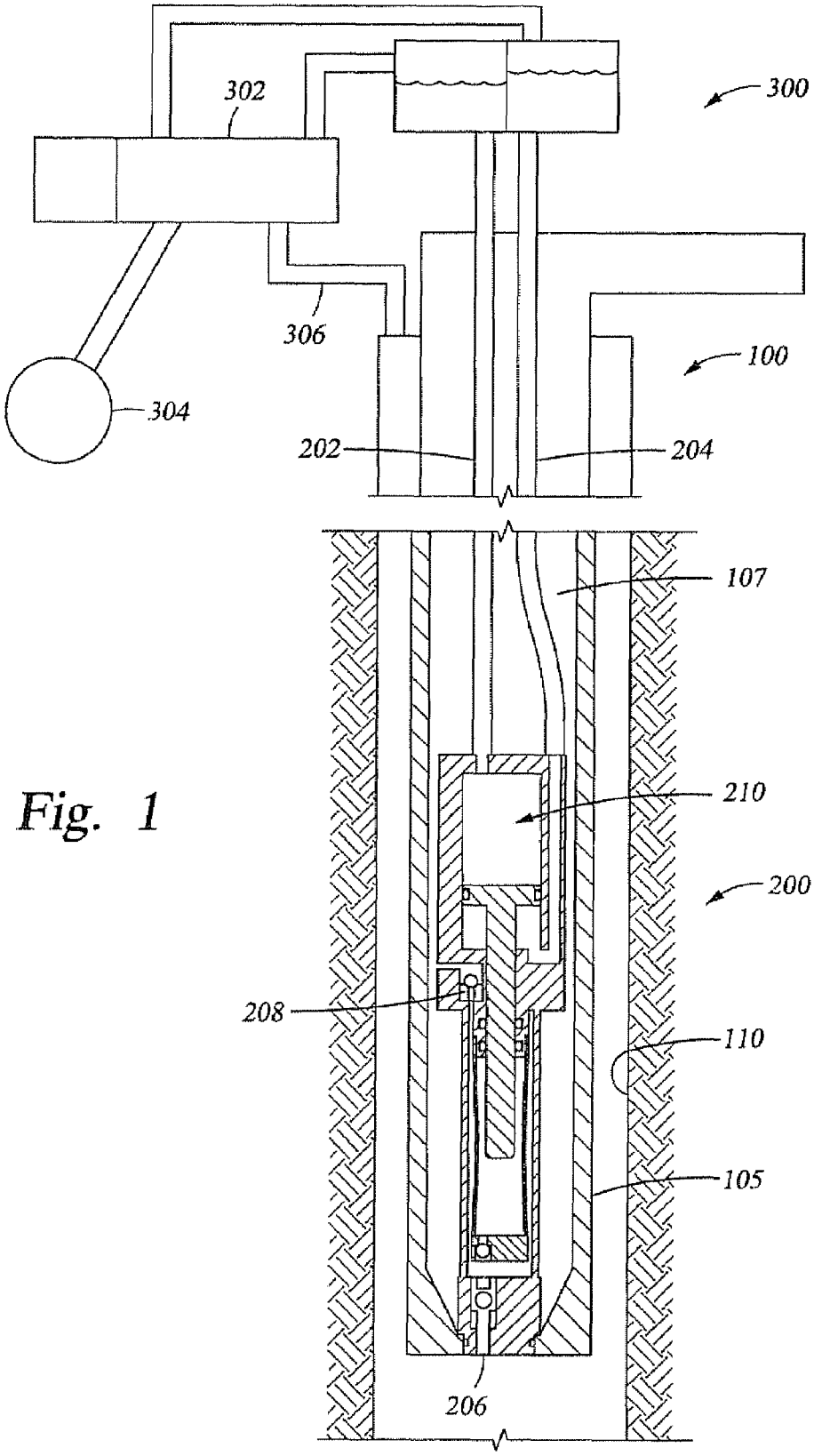
FIG. 1 is a partial sectional and schematic representation of a submersible pumping system constructed in accordance with embodiments of the present invention.

Referring now to FIG. 1, pumping system 100 comprises submersible pump 200 and surface equipment 300. Submersible pump 200 is disposed within tubing 105 in well 110. Tubing 105 forms a flowbore 107 that extends to surface equipment 300 and carries fluid from submersible pump 200 to the surface. Submersible pump 200 is connected to surface equipment 300 via hydraulic tubing 202 and 204.

The operation of submersible pump 200 draws fluid from well 110 through inlet 206. The fluid is pressurized by pump 200 and pumped out through outlet 208 and to the surface through flowbore 107. Submersible pump 200 is powered by hydraulic intensifier 210 that is supplied by hydraulic tubing 202 and 204. The supply of hydraulic fluid through hydraulic tubing 202 and 204 is controlled by valve 302, which applies a reversing differential pressure to operate submersible pump 200. In some embodiments, this differential pressure is based on the differential pressure between pipeline 304 and production gas outlet 306.

Figure 2:
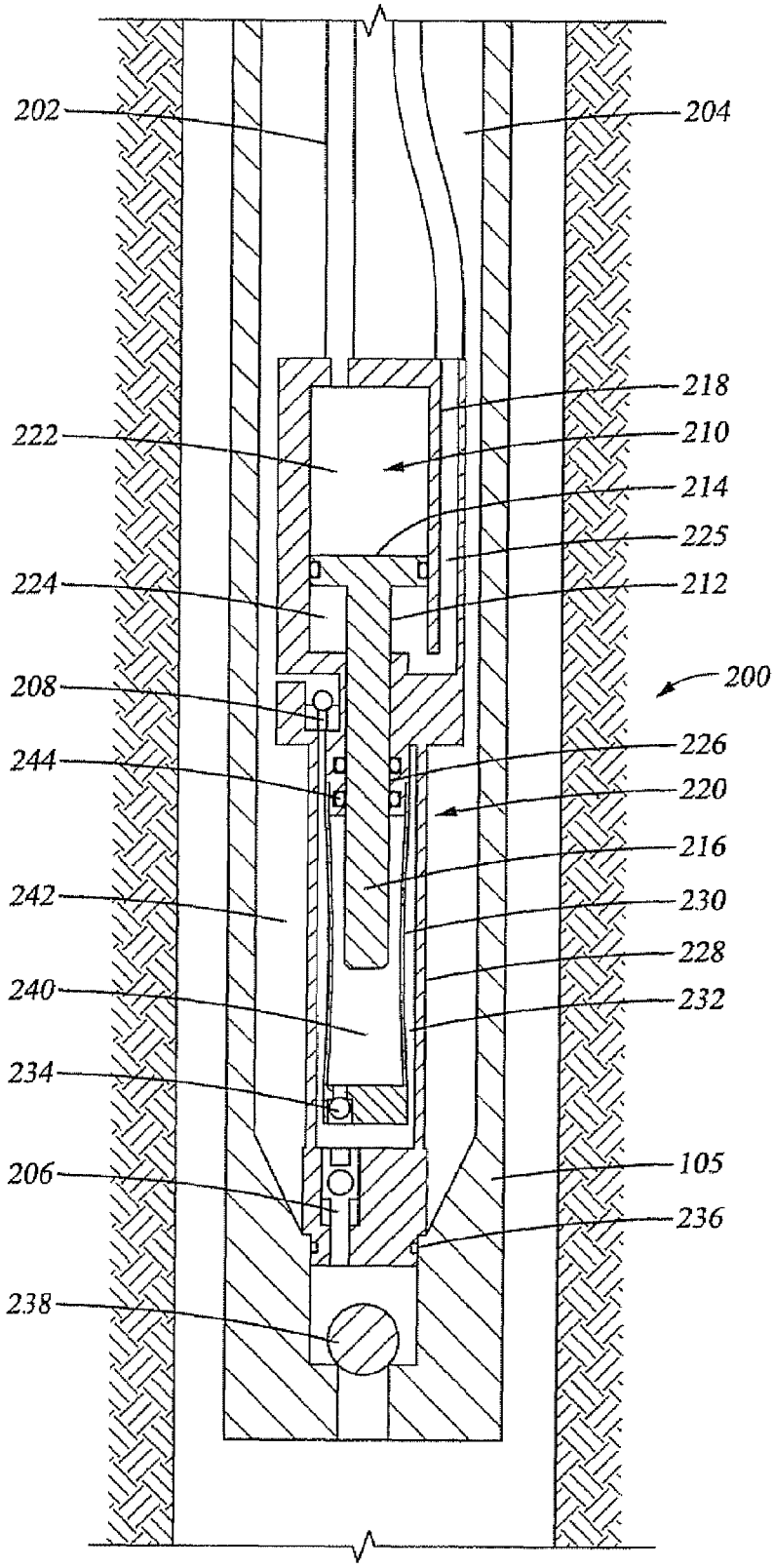
FIG. 2 is a partial sectional view of one embodiment of a submersible pump constructed in accordance with the present invention.

Referring now to FIG. 2, submersible pump 200 is shown engaged with tubing 105. Submersible pump 200 comprises hydraulic intensifier 210 and diaphragm pump 220. Hydraulic intensifier 210 includes piston 212 having head 214 and rod 216. Head 214 is enclosed in intensifier chamber 218 and forms extending chamber 222 and retracting chamber 224. Rod 216 extends through aperture 226 in chamber 218 and into diaphragm pump 220. Extending chamber 222 is in fluid communication with hydraulic tubing 202. Retracting chamber 224 is in fluid communication with hydraulic tubing 204 through passageway 225.

Diaphragm pump 220 comprises pumping chamber 228 that encloses diaphragm 230 and forms an annular pump chamber 232. Inlet 206 and outlet 208 control the movement of fluids through pump 220. Diaphragm 230 is a flexible membrane that defines a boundary between the wellbore fluids in pump chamber 232 from hydraulic fluid within diaphragm chamber 240. Release valve 234 allows the release of hydraulic fluid from diaphragm chamber 240 at a predetermined pressure in order to prevent overpressurization of diaphragm 230.

Pumping chamber 228 forms an annular tubing chamber 242 with tubing 105. Tubing chamber 242 receives pressurized fluid from outlet 208 and is in fluid communication with flowbore 107. Submersible pump 200 is sealingly engaged with tubing 105 by seals 236. Ball valve 238 allows fluid to flow into pump 200 through inlet 206

Figure 3:
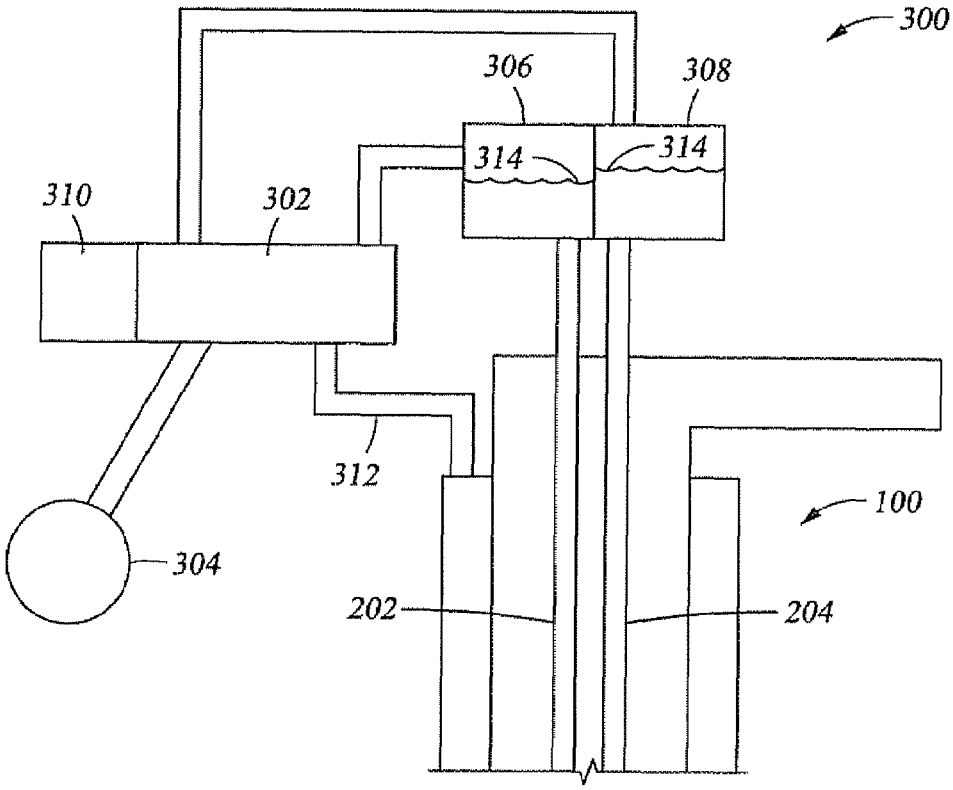
FIG. 3 is a schematic representation of one embodiment of surface equipment constructed in accordance with the present invention.

Referring now to FIG. 3, surface equipment 300 is shown including valve 302 that supplies gas to hydraulic fluid pressurization chambers 306 and 308. Valve 302 comprises differential pressure reversing valve 310 and is connected to pipeline 304 and gas supply 312. Valve 302 is a two position valve that shifts the selectively supplies gas from pipeline 304 or gas supply 312 to chambers 306 and 308. Gas supply 312 may be pressurized gas from wellbore 110 or another supply of gas providing a desired differential pressure with pipeline 304. Pipeline 304 may be a local production pipeline or any other gas source that provides the desired differential pressure with gas supply 312.

Surface equipment 300 uses a gas-over-liquid scheme to develop the hydraulic pressure needed to drive submersible pump 200. Valve 302 applies gas pressure from pipeline 304 or gas supply 312 to chambers 306 and 308 to pressurize hydraulic tubing 202 and 204. Chambers 306 and 308 include a gas/liquid interface 314 that transfers the pressure from pipeline 304 or supply 312 to the fluid within hydraulic tubing 202 and 204.

Referring back to FIG. 2, the pressurized fluid is conveyed through hydraulic tubing 202 and 204 to hydraulic intensifier 210 where it applies a differential pressure across head 214 of piston 212. The differential pressure across head 214 will be equal to the differential pressure between pipeline 304 and supply 312 and causes piston 212 to move into and out of the diaphragm chamber 240.

The movement of piston 210 into diaphragm chamber 240 compresses the hydraulic fluid within the chamber and causes diaphragm 230 to expand. This expansion increases the fluid pressure within pump chamber 232 and forces fluid out of outlet 208. Inlet 206 closes as the pressure increases within pump chamber 232 in order to prevent fluid from flowing back into the wellbore.

The movement of piston 210 out of diaphragm chamber 240 decreases the pressure acting on the chamber and allows diaphragm 230 to retract, thus lowering the pressure within pump chamber 232. This lowered pressure closes outlet 208 and opens inlet 206 in order to allow fluid to be drawn into pump chamber 232. Piston 210 then reverses to pressurize pump chamber 232 and push fluid through outlet 208.

In certain embodiments, a sensor, either directly or pressure activated, may be used to sense when piston 210 has reached the end of its stroke. In this embodiment, valve 302 includes a sensor monitoring the pressure of the gases supplied to chambers 306 and 308. In certain embodiments, the sensor may be located either downhole, near the pumping unit, or at the surface, near the power unit. The sensor may be a pressure switch, activation lever, electronic pressure sensor, or a timing device. The valve 302 may be activated by the sensor either hydraulically, directly or electrically to reverse the state of valve 302 in order to reverse piston 210.

Although the design of the pump prevents damage to the diaphragm due to overstroking, the switching system should prevent damage to the structure of the pump due to jarring loads caused by the overextension of piston 210, more importantly, the most efficient operation of the pump is obtained by switching the pump when piston 210 reaches the end of it's travel. In order to further prevent damage to diaphragm 230, release valve 234 may be provided so as to open if the fluid in diaphragm chamber 240 exceeds a predetermined level.

Although release valve 234 may release some volume of fluid from diaphragm chamber 2240, piston seals 244 tend to allow a slow leakage of hydraulic fluid from retract chamber 224 into diaphragm chamber 240. This leakage also serves to replenish the fluid within diaphragm chamber 240 and may be able to sustain operations if diaphragm 230 develops a leak.

In the control system shown in FIG. 3, the differential pressure between pipeline 304 and gas supply 312 is equal to the differential pressure applied to head 214 of piston 210. Because head 214 has a larger diameter than shaft 216, piston 210 acts as a pressure intensifier. The pressure applied by shaft 216 is greater than the differential pressure acting on head 214 by a ratio equal to the ratio between the diameter of head to the diameter of the shaft. For example, a 10 to 1 diameter ratio would allow a 100 psi differential pressure source to create a 1000 psi differential pressure across the diaphragm pump.

In some embodiments, one or more additional intensifiers can be added to allow even lower differential gas pressure to drive the system. This additional intensifiers can be located at the surface or downhole and act to intensify the pressure in the gas supplies or in the hydraulic fluid. In a multi-intensifier application, the intensifiers may be arranged to act like gears in order to allow a small amount of pressure to create a large amount of lift downhole. The multi-intensifier system may include selective bypass lines in order to use a subset of the intensifiers as desired.

Figure 4:
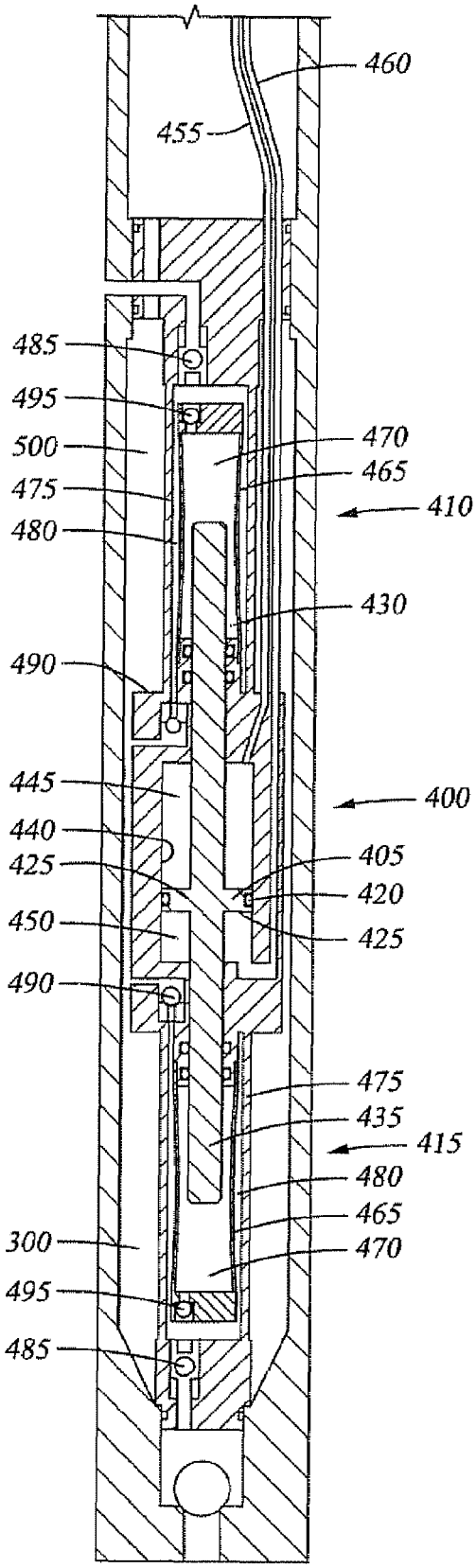
FIG. 4 is a partial sectional view of one embodiment of a submersible pump constructed in accordance with the present invention.

Referring now to FIG. 4, a double action pumping system 400 is shown including intensifier 405, upper diaphragm pump 410, and lower diaphragm pump 415. Intensifier 405 includes actuator 420 having head 425, upper piston 430, and lower piston 435. Head 425 of actuator 420 seals against intensifier chamber 440 to form an upper chamber 445 and lower chamber 450. Hydraulic line 455 supplies upper chamber 445. Hydraulic line 460 supplies lower chamber 450.

Upper diaphragm pump 410 and lower diaphragm pump 420 each comprise diaphragms 465 forming diaphragm chambers 470, having emergency outlets 495. Diaphragms 465 are disposed within pump bodies 475 to form pump chambers 480, each having inlet 485 and outlet 490. Inlets 485 draws low pressure fluids from the wellbore. Outlets 490 move pressurized fluids from pump chambers 480 into flowbore 500, which carries the fluid to the surface.

A hydraulically-driven diaphragm pump can be driven directly from low differential gas pressure energy sources, such as the pressure differential between a wellhead and a sales pipeline. This pump allows producers to use existing gas pressure to provide the energy to pump wells that would otherwise need an auxiliary energy source, saving the producer the cost of infrastructure, maintenance and energy. The resulting system may achieve direct drive of the pump from almost any source of differential gas pressure, but also reduce the cost and complexity of the resulting system, giving a lower cost, more reliable solution.

A hydraulic diaphragm submersible pump should be able to pump up to 100 BFPD (barrels of fluid per day) from depths up to 10,000 feet using differential gas pressure as low as 50 PSI (pounds per square inch). A common application will produce 50 to 300 BFPD, at depths up to 4,000 feet. Lower gas pressures may be required for shallower wells and/or lower flow rates.

The hydraulically-driven diaphragm pump may also provide a compact, lightweight package, allowing deployment inside conventional 2⅞ inch tubing using a rigless pump deployment system, which enables the system to be placed and retrieved without removing the tubing from the well. A rigless pump deployment system is described in co-pending U.S. patent application Ser. No. 10/804,792, filed Mar. 19, 2004 and entitled "Submersible Pump Deployment and Retrieval System," which is hereby incorporated by reference herein in its entirety.

In some embodiments the hydraulic tubing (202 and 204) may be enclosed in a fluid filed liner. The liner may be filled with a fluid having substantially the same density as the wellbore fluids, thus making the hydraulic tubing and liner assembly substantially neutral buoyant. The use of a fluid filled liner also allows the hydraulic tubing to have no differential pressure developed from depth of deployment. By having a fluid with a density matching the wellbore fluids and providing a hydraulic fluid of substantially the same density, the pressure difference across the hydraulic tubing is substantially zero when the pump is turned off. Having the density of the fluids inside and outside the hydraulic tubing substantially the same allows the use of very lightweight tubing to be used to drive the pump regardless of depth of placement. The tubing needs only to be capable of withstanding the differential pressure needed to drive the pump.

Figure 5:
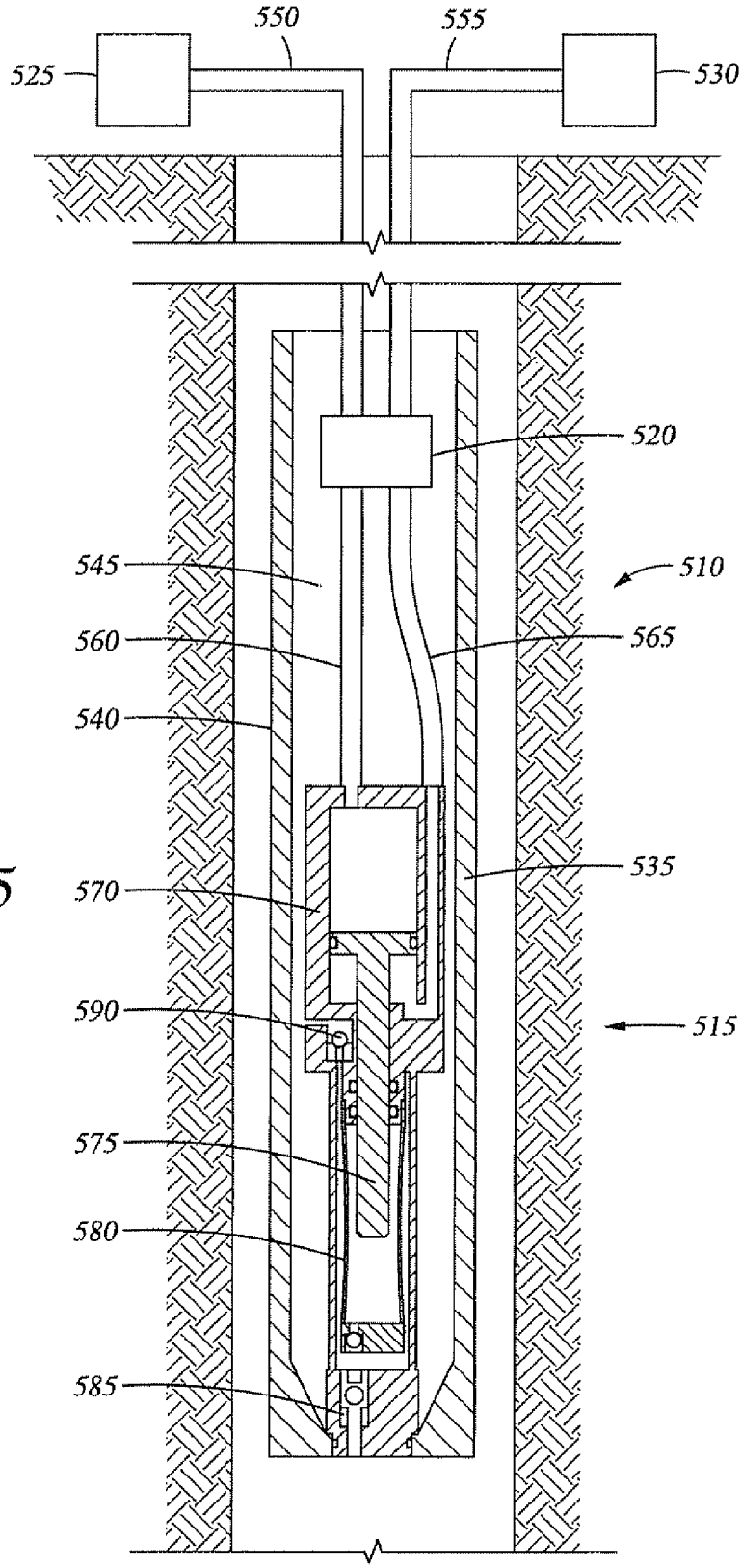
FIG. 5 is a is a partial sectional view of another embodiment of a submersible pump constructed in accordance with the present invention.

Referring now to FIG. 5 an alternate embodiment of pumping system 510 comprises submersible pump 515, submersible valve 520, and surface pressure supplies 525 and 530. Submersible pump 515 is disposed within production tubing 535 in well 540. Production tubing 535 forms a flowbore 545 that carries fluid from submersible pump 515 to the surface. Submersible valve 520 is connected to surface pressure supplies 525 and 530 by hydraulic tubing 550 and 555, respectively. Submersible valve 520 is connected to submersible pump 515 by hydraulic tubing 560 and 565.

Submersible pump 515 is actuated by a hydraulic pressure differential being applied through hydraulic tubing 560 and 565 to pressure intensifier 570. The pressure differential applied to pressure intensifier caused piston 575 to move relative to diaphragm pump 580 causing fluid to be drawn in through inlet 585 and pumped through outlet 590. As piston 575 reaches the end of its stroke, valve 520 reverses the differential pressure applied to pressure intensifier 520 by regulating the pressure applied through tubing 560 and 565.

Surface pressure supplies 525 and 530 may be similar to the high and low pressure gas supplies 304,306 as shown in FIGS. 1 and 3. In an alternative embodiment, pressure supplies 525 and 530 could be hydraulic pumps that are driven by electric or gas powered motors and may find particular application when electrical or mechanical power is available. The hydraulic pumps would directly supply the pressurized hydraulic fluid to the downhole pump or valve. Hydraulic pumps could also be used as an alternative to the surface equipment of FIGS. 1 and 3.

The advantages of a system designed in accordance with the embodiments described herein are substantial. The producer has the advantages of a diaphragm pump, without having to install power lines or generators. The use of differential gas pressure may significantly reduce the cost of power and/or fuel to pump fluids from a given well. Further, a system can be installed and retrieved using rigless deployment, giving the advantage of reduced pump pull and run costs.

A hydraulically-driven diaphragm pump system may also be designed to be mechanically robust while providing greater pump down and more versatility then other gas lift solutions. For a particular class of wells, namely those without power, but with differential gas pressure, this solution solves the dual problems of artificial lift and power availability, significantly reducing installation and operations costs to the producer.

While preferred embodiments of this invention have been shown and described, modifications thereof can be made by one skilled in the art without departing from the scope or teaching of this invention. The embodiments described herein are exemplary only and are not limiting. Many variations and modifications of the system and apparatus are possible and are within the scope of the invention. For example, the relative dimensions of various parts, the materials from which the various parts are made, and other parameters can be varied, so long as the apparatus retain the advantages discussed herein. Accordingly, the scope of protection is not limited to the embodiments described herein, but is only limited by the claims that follow, the scope of which shall include all equivalents of the subject matter of the claims.

What is claimed is:

1. A submersible pump comprising:

a pump body operable to be disposed within tubing within a well;

a pump chamber disposed within the pump body and having an inlet and an outlet, wherein the inlet is in fluid communication with the well;

a diaphragm disposed within said pump chamber, wherein said diaphragm forms a boundary between said pump chamber and a diaphragm chamber;

a piston moveably disposed within the diaphragm chamber; and a pressure intensifier operable to move said piston within the diaphragm chamber in response to a pressure differential received from the surface.

2. The submersible pump of claim 1 further comprising:

a pressure supply disposed at the surface of the well; and hydraulic tubing providing fluid communication between said pressure supply and said pressure intensifier.

3. The submersible pump of claim 2 wherein said pressure supply further comprises:

a first supply of fluid at a first pressure; and a second supply of fluid at a second pressure, wherein the first pressure and the second pressure establish a pressure differential that is applied to said pressure intensifier to move said piston within the diaphragm chamber.

4. The submersible pump of claim 3 wherein the first and second supplies of fluid are pressurized gases, wherein the pressure differential between the first and second supplies is applied to a hydraulic fluid disposed within the hydraulic tubing.

5. The submersible pump of claim 4 wherein the hydraulic fluid has substantially the same density as fluid within the well.

6. The submersible pump of claim 4 wherein the diaphragm chamber contains the hydraulic fluid.

7. A submersible pump comprising:

a pump body operable to be disposed within tubing within a well;

a pump chamber disposed within the pump body and having an inlet and an outlet, wherein the inlet is in fluid communication with the well;

a diaphragm disposed within said pump chamber, wherein said diaphragm forms a boundary between said pump chamber and a diaphragm chamber;

a piston moveably disposed within the diaphragm chamber; and a relief valve in fluid communication with the diaphragm chamber, wherein said relief valve limits the differential pressure between the diaphragm chamber and the pump chamber.

8. A well pumping system comprising:

a hydraulic fluid supply located at the surface and operable to provide a first fluid pressure differential;

hydraulic tubing extending into the well from the hydraulic fluid supply to a submersible pump disposed within the well;

a pressure intensifier coupled to said hydraulic tubing and operable to apply the first fluid pressure differential to a piston;

a diaphragm chamber containing a volume of hydraulic fluid, wherein a portion of the piston is disposed within said diaphragm chamber; and a diaphragm forming a flexible barrier between said diaphragm chamber and a pump chamber in fluid communication with the well.

9. The pumping system of claim 8 wherein said pumping system is operable to provide a second pressure differential in response to movement of the piston within said diaphragm chamber.

10. The pumping system of claim 9 wherein movement of the piston within said diaphragm chamber is determined by monitoring hydraulic fluid pressure.

11. The pumping system of claim 8 wherein said hydraulic fluid supply further comprises:

a first gas supply at a first pressure; and a second gas supply at a second pressure, wherein the second pressure is higher than the first pressure;

a first pressurization chamber wherein either the first of second pressure is transferred to a first hydraulic fluid supply; and a second pressurization chamber wherein either the first or second pressure is transferred to a first hydraulic fluid supply.

12. The pumping system of claim 11 further comprising a valve having a first position wherein the first pressure is applied to said first pressurization chamber and the second pressure is applied to said second pressurization chamber, wherein said valve has a second position wherein the first pressure is applied to said second pressurization chamber and the second pressure is applied to said first pressurization chamber.

13. The pumping system of claim 12 wherein said valve shifts from the first to the second position in response to movement of the piston within said diaphragm chamber.

14. The pumping system of claim 12 wherein said valve shifts from the first to the second position in response to changes in the pressure within the pressurization chambers.

15. The pumping system of claim 11 wherein said hydraulic tubing comprises a first and second length of hydraulic tubing, wherein the first length carries fluid from the first hydraulic fluid supply and the second length carries fluid from the second hydraulic fluid supply.

16. The pumping system of claim 8 further comprising a relief valve in fluid communication with said diaphragm chamber, wherein said relief valve limits the differential pressure between the diaphragm chamber and the pump chamber.

17. A well pumping method comprising:

disposing a hydraulic submersible pump within the well, wherein said hydraulic submersible pump comprises a diaphragm pump comprising a piston moveably disposed within a diaphragm chamber;

connecting hydraulic tubing from the hydraulic submersible pump to a fluid supply at the surface; and supplying hydraulic fluid from the surface to move the piston relative to the diaphragm chamber.

18. The method of claim 17, wherein the diaphragm pump further comprises a pressure intensifier that receives the hydraulic fluid from the surface and moves the piston relative to the diaphragm chamber.

19. The well pumping method of claim 18 further comprising supplying the hydraulic fluid to the pressure intensifier at a first differential pressure.

20. The well pumping method of claim 19 wherein the diaphragm pump comprises a piston partially disposed within a diaphragm chamber, wherein the first differential pressure extends the piston into the diaphragm chamber so as to expand the diaphragm chamber and pressurize wellbore fluids within the diaphragm pump.

21. The well pumping method of claim 20 further comprising supplying the hydraulic fluid to the pressure intensifier at a second differential pressure.

22. The well pumping method of claim 21 wherein the second differential pressure retracts the piston from the diaphragm chamber so as to collapse the diaphragm chamber and draw wellbore fluids into the diaphragm pump.

23. The well pumping method of claim 22 wherein the fluid supply alternates between supplying hydraulic fluid at the first differential pressure and second differential pressure based on movement of the piston.

24. The well pumping method of claim 23 wherein movement of the piston is determined by monitoring pressure of the hydraulic fluid.

* * * * *